US011215032B2

(12) United States Patent
Xiao et al.

(10) Patent No.: US 11,215,032 B2
(45) Date of Patent: Jan. 4, 2022

(54) DEVICES AND METHODS TO MITIGATE PRESSURE BUILDUP IN AN ISOLATED WELLBORE ANNULUS

(71) Applicant: SAUDI ARABIAN OIL COMPANY, Dhahran (SA)

(72) Inventors: Jinjiang Xiao, Dhahran (SA); Chidirim Enoch Ejim, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 44 days.

(21) Appl. No.: 16/751,433

(22) Filed: Jan. 24, 2020

(65) Prior Publication Data

US 2021/0230969 A1 Jul. 29, 2021

(51) Int. Cl.
*E21B 41/00* (2006.01)
*E21B 34/06* (2006.01)
*E21B 33/124* (2006.01)

(52) U.S. Cl.
CPC ..... *E21B 41/00* (2013.01); *E21B 34/06* (2013.01); *E21B 33/124* (2013.01)

(58) Field of Classification Search
CPC ..... E21B 34/06; E21B 33/124; E21B 41/00
See application file for complete search history.

(56) References Cited

U.S. PATENT DOCUMENTS 3,882,937 A 5/1975 Robinson
4,453,892 A * 6/1984 Brookbank, III ..... F04B 47/02 137/508
6,293,346 B1 9/2001 Patel
6,328,071 B1 * 12/2001 Austin ..... F04D 13/16 138/30
6,910,532 B2 * 6/2005 Meyers ..... E21B 33/00 166/85.2
2004/0055758 A1 3/2004 Brezinski et al.
2004/0069495 A1 4/2004 Adams et al.
2005/0189107 A1 * 9/2005 McVay ..... E21B 41/00 166/242.1
2005/0194144 A1 9/2005 Vargo et al.
(Continued)

FOREIGN PATENT DOCUMENTS

CN 201778759 U 3/2011
CN 108590509 A 9/2018
(Continued)

OTHER PUBLICATIONS

Zhou et al. "Mechanism of pressure management by injecting nitrogen in casing annulus of deepwater wells," Petroleum Exploration and Development, vol. 42, Issue 3, 2015, Online English edition of the Chinese language journal, ScienceDirect (5 pages).
(Continued)

*Primary Examiner* — Brad Harcourt
(74) *Attorney, Agent, or Firm* — Osha Bergman Watanabe & Burton LLP

(57) ABSTRACT

A device to mitigate pressure buildup in an isolated wellbore annulus containing fluid includes a tubular body and a container disposed around the tubular body. The container is pre-filled with a charge of gas. When the device is disposed in the isolated wellbore annulus, the gas in the container is compressed in response to expanding fluid in the isolated wellbore annulus.

20 Claims, 10 Drawing Sheets

(56) References Cited

U.S. PATENT DOCUMENTS

| | | | | |
|---|---|---|---|---|
| 2007/0114033 | A1 | 5/2007 | Hermes et al. | |
| 2009/0272545 | A1 | 11/2009 | Bour | |
| 2010/0122811 | A1 | 5/2010 | Maskos et al. | |
| 2011/0114333 | A1 | 5/2011 | Fenton | |
| 2013/0032354 | A1* | 2/2013 | Gerrard | E21B 34/101 166/373 |
| 2013/0056196 | A1 | 3/2013 | Hench | |
| 2013/0248181 | A1 | 9/2013 | Getzlaf et al. | |
| 2015/0013988 | A1 | 1/2015 | Ravi et al. | |
| 2017/0321515 | A1 | 11/2017 | St Hr | |
| 2018/0148992 | A1 | 5/2018 | Vasques | |
| 2018/0266188 | A1 | 9/2018 | Levie et al. | |
| 2019/0063191 | A1 | 2/2019 | Roussie | |

FOREIGN PATENT DOCUMENTS

| | | | |
|---|---|---|---|
| KR | 20150061530 | A | 6/2015 |
| WO | 2011/146169 | A2 | 11/2011 |

OTHER PUBLICATIONS

Zhang et al. "Appropriate completion to prevent potential damage of annular pressure buildup in deepwater wells," SPE-180542-MS: paper presented at the Asia Pacific Drilling Technology Conference held in Singapore, Aug. 22-24, 2016 (13 pages).

Alquwizani et al. "Managing Tubing-Casing-Annulus in ESP Completions for Enhanced Wellbore Integrity and Improved ESP Runlife" SPE-173702-MS, 2014 (11 pages).

Sathuvalli et al. "Design and Performance of Annular-Pressure-Buildup Mitigation Techniques" SPE 178886, Society of Petroleum Engineers, Sep. 2017 (16 pages).

* cited by examiner

DEVICES AND METHODS TO MITIGATE PRESSURE BUILDUP IN AN ISOLATED WELLBORE ANNULUS

FIELD

The disclosure relates generally to pressure storage devices and particularly to use of pressure storage devices to mitigate pressure buildup in an isolated wellbore annulus.

BACKGROUND

FIG. 1 shows a portion of a well 100 traversing subsurface formations. Well 100 has been completed for production of fluids, e.g., hydrocarbons. A tubing 116 and casings 120, 124, 128 (the number of casings are merely for illustrative purposes) are disposed in well 100 in a generally concentric arrangement. A tubing-casing annulus 104 is formed between tubing 116 and casing 120. A casing-casing annulus 108 is formed between casings 120, 124, and a casing-casing annulus 112 is formed between casings 124, 128. A lower completion packer 132 is set between tubing 116 and casing 120 to seal the bottom of tubing-casing annulus 104. Tubing 116 may be a production tubing including an electric submersible pump (ESP) 136. An upper completion packer 140 is set between tubing 116 and casing 120 and above ESP 136 to seal tubing-casing annulus 104 just above ESP 136. A trapped space 104*a* is formed in tubing-casing annulus 104 between packers 132, 140. A packer penetrator 144 may be installed at upper completion packer 140 to transmit power between a lower portion 148*a* and an upper portion 148*b* of an ESP cable 148. ESP cable portion 148*a* is connected to packer penetrator 144, while ESP cable portion 148*b* extends from packer penetrator 144, up tubing-casing annulus 104, and to the surface. Typically, tubing-casing annulus 104 is filled with inhibited brine 152, which is brine with substances to inhibit corrosion. A wellhead at the surface (not shown) seals tubing-casing annulus 104 at the top. Because tubing-casing annulus 104 is sealed at the top by the wellhead (not shown) and at the bottom by packer 132, the inhibited brine 152 is within a sealed volume.

After ESP 136 is started up, warm production fluids will be produced to the surface through tubing 116, as shown by arrow 156. As the warm production fluids are produced to the surface, the well will begin to warm up. As the well warms up, inhibited brine 152 in tubing-casing annulus 104 will expand, causing annular pressure rise within tubing-casing annulus 104. This annular pressure rise may be referred to as "annular pressure buildup (APB)". This process of annular pressure buildup can last a few days until the well is fully warmed up and the temperature in the well reaches steady state. Without timely bleed-down, the annular pressure in tubing-casing 104 can increase dramatically, leading to possible collapse of tubing 116 and/or other damages, such as wellhead rupture and failure of any of packer(s) 132, 140, casing 120, ESP cable 148, and packer penetrator 144. Operationally, monitoring and performing timely bleed-down can be very involved, especially offshore. For an unmanned platform, this requires that a work boat has to be kept next to the platform for a few days after startup just to monitor the tubing-casing annulus for one or a few wells.

SUMMARY

In one aspect, a device to mitigate pressure buildup in an isolated wellbore annulus containing fluid may be summarized as including a tubular body having an outer wall surface and a first longitudinal axis; a chamber formed with at least one rigid wall, the chamber disposed around the outer wall surface of the tubular body and having a second longitudinal axis extending in the same direction as the first longitudinal axis; and a flexible container to hold a charge of gas, the flexible container disposed within the chamber and arranged to deform in a direction along the second longitudinal axis in response to fluid pressure changes in an external environment of the device.

The flexible container may be pre-filled with an inert gas.

The at least one rigid wall may include a shroud casing disposed around the outer wall surface of the tubular body. The shroud casing has an inner wall surface that is radially spaced from the outer wall surface of the tubular body, and the chamber is formed between the inner wall surface of the shroud casing and the outer wall surface of the tubular body.

The device may include at least one support that attaches the shroud casing to the outer wall surface of the tubular body. The chamber may have a closed end proximate the at least one support and an open end that is longitudinally opposed to the closed end. The open end permits flow of fluid from the external environment of the device into the chamber. The at least one support may be a flange that is carried by the outer wall surface of the tubular body.

The device may include two supports that attach the shroud casing to the outer wall surface of the tubular body. The two supports are spaced apart in a direction along the first longitudinal axis of the tubular body, and the chamber extends between the two supports. At least one of the two supports includes at least one opening to receive fluid from the external environment of the device into the chamber. A valve may be positioned to control flow of fluid through the at least one opening in response to fluid pressure changes in the external environment of the device.

The flexible container has longitudinally opposed ends and may be restrained at one of the longitudinally opposed ends.

The flexible container may be an elastomeric bag, metal bellows, or a bladder.

In another aspect, a device to mitigate pressure buildup in an isolated wellbore annulus containing fluid may be summarized as including a tubular body having an outer wall surface and a flexible container pre-filled with a charge of gas and sealed to an external source of gas once pre-filled. The flexible container is disposed around the outer wall surface of the tubular body. The flexible container has an external surface that is exposed at an exterior of the device and deforms in response to fluid pressure exerted on the external surface from the environment of the device. The flexible container may be pre-filled with an inert gas. The flexible container may be retained on the outer wall surface of the tubular body.

In another aspect, a method of mitigating pressure buildup in an isolated wellbore annulus containing fluid may be summarized as including pre-filling a flexible container with a charge of gas and sealing the flexible container to an external source of gas once pre-filled with the charge of gas and disposing the flexible container pre-filled with the charge of gas in the isolated annulus of the well, whereby the flexible container pre-filled with the charge of gas deforms in response to fluid pressure changes in the isolated wellbore annulus.

The method may further include retaining the flexible container pre-filled with the charge of gas within a chamber formed with at least one rigid wall such that the flexible container is longitudinally deformable within the chamber;

disposing the chamber with the flexible container retained therein in the isolated wellbore annulus; and, in response to fluid pressure changes in the isolated wellbore annulus, receiving expanding fluid into the chamber from the isolated wellbore annulus, the expanding fluid exerting a pressure on the flexible container that longitudinally deforms the flexible container and compresses the gas within the flexible container. The flexible container may be pre-filled with inert gas. The expanding fluid may comprise inhibited brine. The chamber with the flexible container retained therein may be coupled to a downhole tool. The method may include deploying the downhole tool into a well comprising the isolated wellbore annulus.

In another aspect, a device to mitigate pressure buildup in an isolated wellbore annulus containing fluid may be summarized as including a tubular body having an outer wall surface; a rigid container disposed around the outer wall surface of the tubular body, the rigid container having an internal chamber to hold a charge of gas; a descender tube extending into a first portion of the internal chamber from proximate a top of the rigid container, the descender tube defining a first flow path for flow of fluid from an external environment of the device to the internal chamber; an ascender tube extending into a second portion of the internal chamber from proximate a bottom of the rigid container, the ascender tube defining a second flow path for supply of gas to the internal chamber; and a gas fill valve positioned to selectively permit filling of the internal chamber with gas through the second flow path.

The rigid container may be fastened to the outer wall surface of the tubular body.

The descender tube may extend into the first portion of the internal chamber through a top end of the rigid container. The ascender tube may extend into the second portion of the internal chamber through a bottom end of the rigid container.

The internal chamber may be pre-filled with an inert gas. The inert gas may be retained in the internal chamber by a connected volume of liquid within the descender tube and internal chamber.

In another aspect, a device to mitigate pressure buildup in an isolated wellbore annulus containing fluid may be summarized as including a first tubular body and a second tubular body axially aligned and coupled together in series; a first rigid container disposed around an outer wall surface of the first tubular body, the first rigid container having a first internal chamber to hold a first portion of a charge of gas; a second rigid container disposed around an outer wall surface of the second tubular body, the second rigid container having a second internal chamber to hold a second portion of the charge of gas; a descender tube extending into the first internal chamber from proximate a top of the first rigid container, the descender tube defining a first flow path for flow of fluid from an external environment of the device to the first internal chamber; a first ascender tube extending into the second internal chamber from proximate a bottom of the second rigid container, the first ascender tube defining a second flow path for supply of gas to the second internal chamber; a second ascender tube extending from the second internal chamber into the first internal chamber, the second ascender tube defining at least a portion of a third flow path connecting the first internal chamber to the second internal chamber; and a gas fill valve positioned to selectively permit charging of the first and second internal chambers with gas through the second flow path.

The first and second rigid containers may be fastened to the outer wall surfaces of the first and second tubular bodies, respectively.

A joint may be formed between a first end connection at an end of the first tubular body and a second end connection at an end of the second tubular body.

The first and second internal chambers may be pre-filled with a charge of an inert gas. The charge of inert gas may be retained within the first and second internal chambers by a connected volume of liquid within the descender tube and the first internal chamber.

In another aspect, a device to mitigate pressure buildup in an isolated wellbore annulus containing fluid may be summarized as including a first tubular body and a second tubular body axially aligned and coupled together in series; a first chamber formed by a first rigid container having at least one wall disposed around an outer wall surface of the first tubular body, the first chamber to hold a first portion of a charge of gas; a second chamber formed by a second rigid container having at least one wall disposed around an outer wall of the second tube, the second chamber to hold a second portion of the charge of gas; a conduit formed between the first chamber and the second chamber; at least one port formed in the first rigid container, the at least one port fluidly connecting the first chamber to an external environment of the device; and a valve positioned to control flow of fluid from the external environment of the device to the first chamber through the at least one port, the valve responsive to a fluid pressure differential between the external environment of the device and the first chamber.

The first chamber may be an internal chamber of the first rigid container.

The second chamber may be an internal chamber of the second rigid container.

The first rigid container may be an outer pipe of a first double-walled pipe, the first tubular body may be an inner pipe of the first double-walled pipe, and the first chamber may be a sealed chamber defined between the outer pipe and the inner pipe of the first double-walled pipe.

The second rigid container may be an outer pipe of a second double-walled pipe, the second tube may be an inner pipe of the first double-walled pipe, and the second chamber may be a sealed chamber defined between the outer pipe and the inner pipe of the second double-walled pipe.

The first and second chambers may be pre-filled with a charge of inert gas.

The first tubular body and the second tubular body may be coupled together in series by a joint formed between a first end connection at an end of the first tubular body and a second end connection at an end of the second tubular body.

A downhole tool for use in production of hydrocarbons from a well may include one or more of any of the devices described above. The downhole tool may include a tubing carrying the device(s). The tubing may include an ESP.

The foregoing general description and the following detailed description are exemplary of the invention and are intended to provide an overview or frame work for understanding the nature of the invention as it is claimed. The accompanying drawings are included to provide further understanding of the invention and are incorporated in and constitute a part of the specification. The drawings illustrate various embodiments of the invention and together with the description serve to explain the principles and operation of the invention.

BRIEF DESCRIPTION OF DRAWINGS

The following is a description of the figures in the accompanying drawings. In the drawings, identical reference numbers identify similar elements or acts. The sizes and relative positions of elements in the drawings are not necessarily drawn to scale. For example, the shapes of various elements and angles are not necessarily drawn to scale, and some of these elements may be arbitrarily enlarged and positioned to improve drawing legibility. Further, the particular shapes of the elements as drawn are not necessarily intended to convey any information regarding the actual shape of the particular elements and have been solely selected for each of recognition in the drawing.

DETAILED DESCRIPTION

Figure 1:
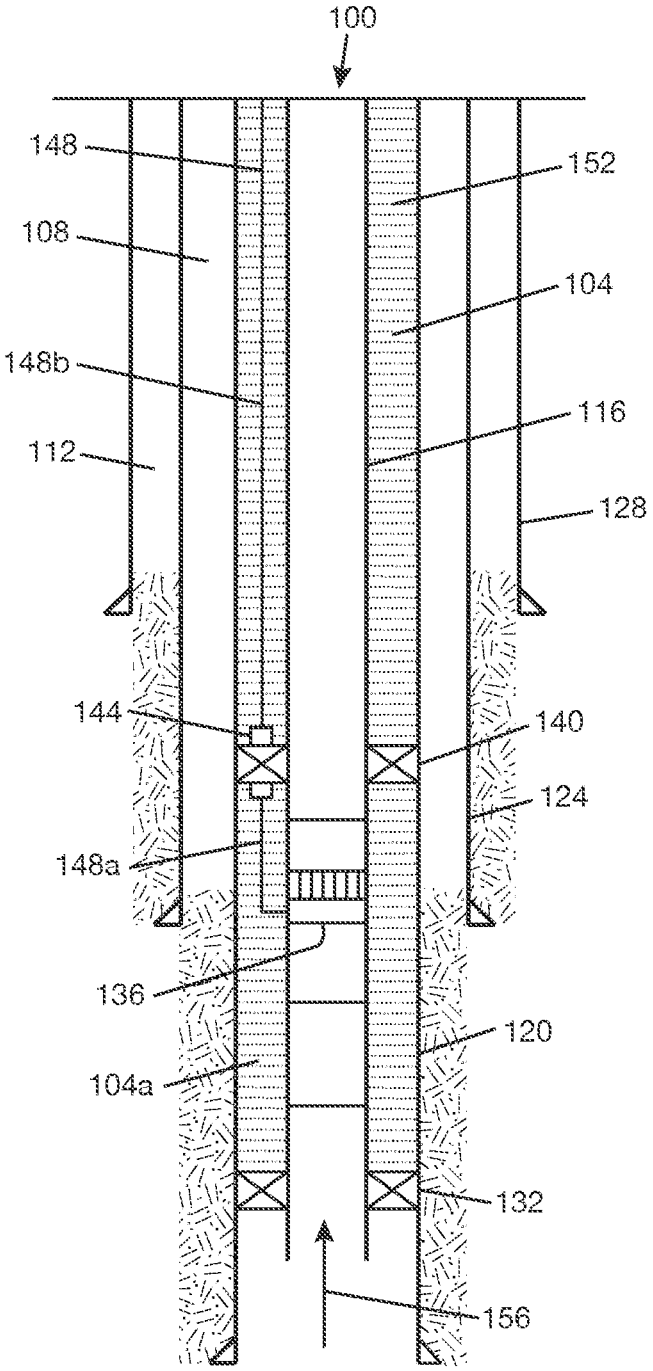
FIG. 1 (PRIOR ART)
FIG. 1 is a schematic diagram of a portion of well that has been completed for production of fluids.

In the following detailed description, certain specific details are set forth in order to provide a thorough understanding of various disclosed implementations and embodiments. However, one skilled in the relevant art will recognize that implementations and embodiments may be practiced without one or more of these specific details, or with other methods, components, materials, and so forth. In other instances, well known features or processes associated with the hydrocarbon production systems have not been shown or described in detail to avoid unnecessarily obscuring descriptions of the implementations and embodiments. For the sake of continuity, and in the interest of conciseness, same or similar reference characters may be used for same or similar objects in multiple figures. For the sake of brevity, the term "corresponding to" may be used to describe correspondence between features of different figures. When a feature in a first figure is described as corresponding to a feature in a second figure, the feature in the first figure is deemed to have the characteristics of the feature in the second figure, and vice versa, unless stated otherwise.

Figure 2A:
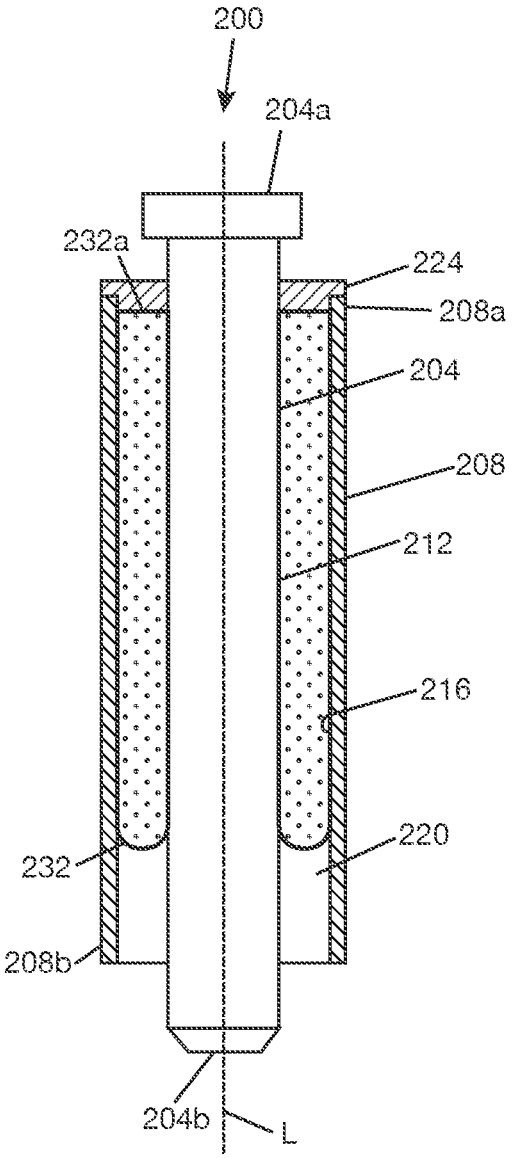
FIG. 2A is a cross-section of a pressure storage device (PSD) according to one embodiment.

FIG. 2A shows a pressure storage device (PSD) 200 that can be used to mitigate pressure buildup in an isolated wellbore annulus according to one illustrative implementation. An "isolated wellbore annulus" is an annulus in a well that is isolated from the remainder of the well, e.g., by placing seal members at the top and bottom of the annulus. PSD 200 includes a tubular body 204 with end connections 204*a*, 204*b*, e.g., threaded connections or other connections known in the art for connecting tubulars, and a longitudinal axis L. Tubular body 204 has a longitudinal bore (not shown) for passage of fluids. A shroud casing 208 is disposed about an outer wall surface 212 of tubular body 204. In general, shroud casing 208 is a rigid wall that can withstand pressure applied by fluid in the external environment of the PSD without being deformed. Shroud casing 208 has an inner wall surface 216 that is radially spaced from outer wall surface 212 of tubular body 204. An annular chamber 220 is defined between inner wall surface 216 of shroud casing 208 and outer wall surface 212 of tubular body 204. Annular chamber 220 has a longitudinal axis (not shown separately) that extends in the same direction as longitudinal axis L of tubular body 204. Shroud casing 208 may be retained on tubular body 204 in any suitable manner that preserves annular chamber 220. As a non-limiting example, an annular flange 224 may be formed on outer wall surface 212 of tubular body 204. An upper end 208*a* of shroud casing 208 may be attached to annular flange 224 to thereby retain shroud casing 208 on tubular member 204. (Alternatively, annular flange 224 may be an annular end cap that is attached to upper end 208*a* of shroud casing 208 and then secured to outer wall surface 212 of tubular body 204.) The radial thickness of annular flange 224 (i.e., a dimension measured in a direction transverse to longitudinal axis L) will provide the desired spacing between shroud casing 208 and tubular body 204 that defines annular chamber 220. The radial thickness of annular flange 224 may or may not be uniform around a circumference of tubular body 204, i.e., annular chamber 220 may concentric or eccentric relative to tubular body 204.

Figure 3A:
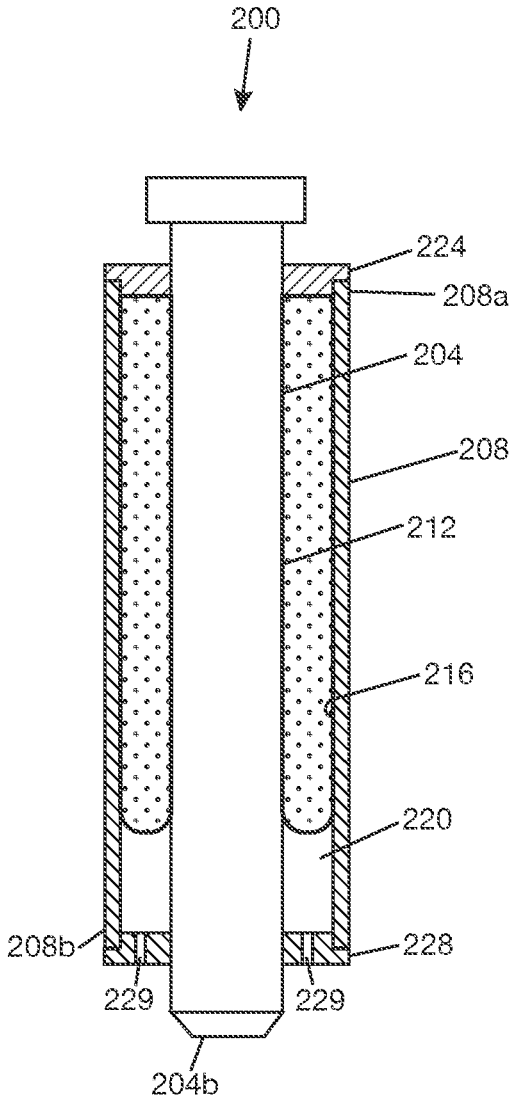
FIG. 3A shows the PSD of FIG. 2A with an alternative shroud casing support system.
Figure 3B:
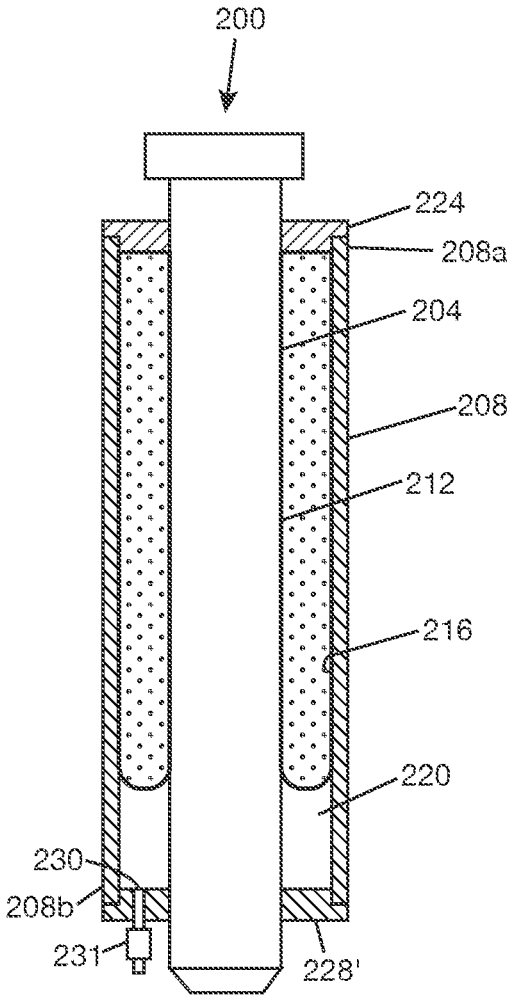
FIG. 3B shows the PSD of FIG. 3A with an alternative flow path between an annular chamber in the PSD and an external environment of the PSD.

In the example shown in FIG. 2A, annular chamber 220 is closed at or near upper end 208*a* of shroud casing 208, e.g., by annular flange 224, and open at or near lower end 208*b* of shroud casing 208. Fluid from an external environment of PSD 200 can enter annular chamber 220 through the open end of annular chamber 220 and leave via the same route. In an alternative example shown in FIG. 3A, previously mentioned annular flange (or end cap) 224 and another annular flange (or end cap) 228 may be provided on outer wall surface 212 of tubular body 204. Annular flanges 224, 228 are spaced apart along the length of tubular body 204. Upper end 208*a* of shroud casing 208 may be attached to annular flange 224 as previously described, and lower end 208*b* of shroud casing 208 may be attached to annular flange 228. In this case, annular chamber 220 extends between annular flanges (or end caps) 224, 228. To allow fluid communication between annular chamber 220 and the external environment of PSD 200, annular flange 228 may be provided with openings 229, e.g., slots. In another example shown in FIG. 3B, annular flange 228' may be provided with a fluid port 230. A valve 231, e.g., a check valve, may be connected to fluid port 230. Valve 231 may be normally closed. Valve 231 may be designed to open when the pressure of fluid in the external environment of PSD 200 exceeds the pressure within annular chamber 220 or when a difference between the pressure of fluid in the external environment of PSD 200 and the pressure within the annular chamber 220 exceeds a predetermined threshold. The positions of annular flanges 224, 228 (228') may be swapped such that fluid comes into annular chamber 220 from above shroud casing 208 (or near the top of shroud casing) rather than from below shroud casing 208 (or near the bottom of shroud casing).

Figure 2B:
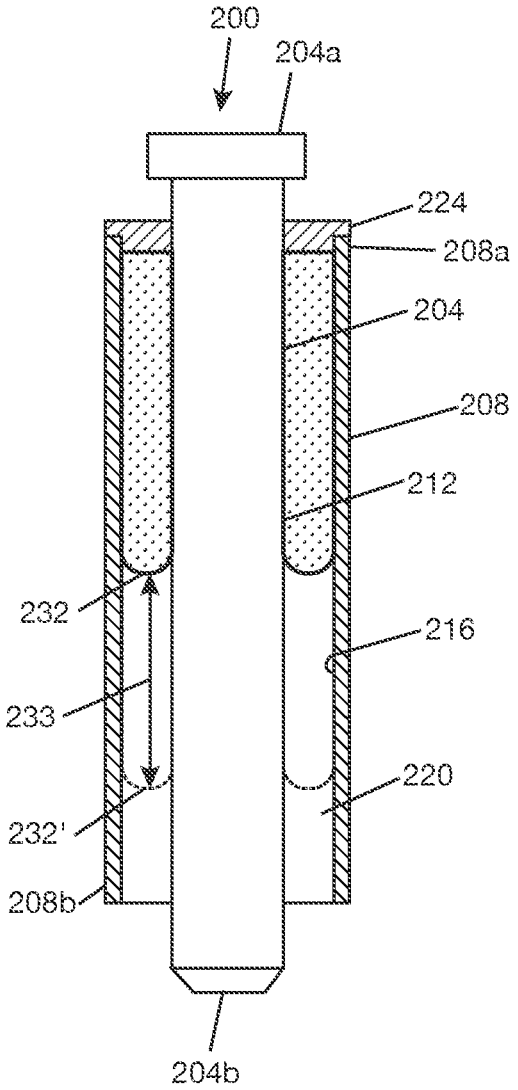
FIG. 2B shows a flexible container of PSD of FIG. 2A in a compressed state.

Returning to FIG. 2A, a flexible container (or deformable container) 232 is disposed within annular chamber 220. Flexible container 232 is a sealed or sealable container that can hold a charge of gas. Flexible container 232 may be, for example, an elastomeric bag, metal bellows, bladder, or the like. In the example shown in FIG. 2A, flexible container 232 has an annular shape that circumscribes outer wall surface 212 of tubular body 204. However, PSD 200 is not limited to a flexible container 232 that has an annular shape or to a single flexible container 232. As an example, two flexible containers having semi-annular shapes may be disposed within annular chamber 220. Flexible container 232 is pre-filled with a charge of gas at low pressure. The term "pre-filled" as used herein and elsewhere means to fill the container with gas prior to use of the associated PSD in mitigating pressure buildup. In a non-limiting example, the pre-fill pressure may be in a range from 0 to 150 psi. However, during mitigation of pressure buildup, the pressure of the gas in the flexible container 232 will rise due to compression of the gas. The pre-fill gas may be nitrogen or other inert gas. In some cases, the flexible container 232 is sealed to an external source of gas once pre-filled with gas, i.e., during use flexible container 232 is not in fluid communication with an external source of gas. When flexible container 232 is not compressed (e.g., when the pressure of the gas in flexible container 232 is still at the pre-fill pressure), flexible container 232 will typically occupy a majority, e.g., greater than 50%, preferably greater than 65%, more preferably greater than 80%, of the volume of annular chamber 220. Flexible container 232 can be compressed by pressure of fluid in annular chamber 220. As flexible container 232 is compressed by fluid pressure within annular chamber 220, the volume of flexible container 232 will become smaller, and the pressure of the gas inside flexible container 232 will change inversely. FIG. 2B shows an example of flexible container 232 in a compressed state—for comparison, the initial size of flexible container 232 is shown by dotted line 232'. As flexible container 232 is compressed, more of the volume of annular chamber 220 will be available to receive fluid from the external environment of PSD 200.

Returning to FIG. 2A, in one implementation, flexible container 232 is supported within annular chamber 220 in a manner that allows the container to longitudinally expand or contract (see arrow 233 in FIG. 2B) in response to fluid pressure within annular chamber 220. In one implementation, one distal end of flexible container 232 is fixed relative to annular chamber 220, e.g., by fixing the end to any of the structures defining annular chamber 220, while the remainder of flexible container 232 (including the other distal end) is not fixed to any structure. In one example, an upper end 232*a* of flexible container 232 is attached to annular flange 224, thereby fixing that end relative to annular chamber 220. The portion of flexible container 232 below upper end 232*a*, which should be a majority of flexible container 232, is not fixed relative to annular chamber 220, which allows flexible container 232 to expand and contract longitudinally (see arrow 233 in FIG. 2B) within annular chamber 220. Because gas is highly compressible, the length of flexible container 232 can become much shorter than what is shown in FIG. 2B in response to applied fluid pressure. As flexible container 232 becomes smaller in size (i.e., becomes more compressed), more fluid from the external environment of PSD 200 will be able to enter annular chamber 220. This will produce a corresponding increase in the pressure of the gas within flexible container 232.

Figure 4:
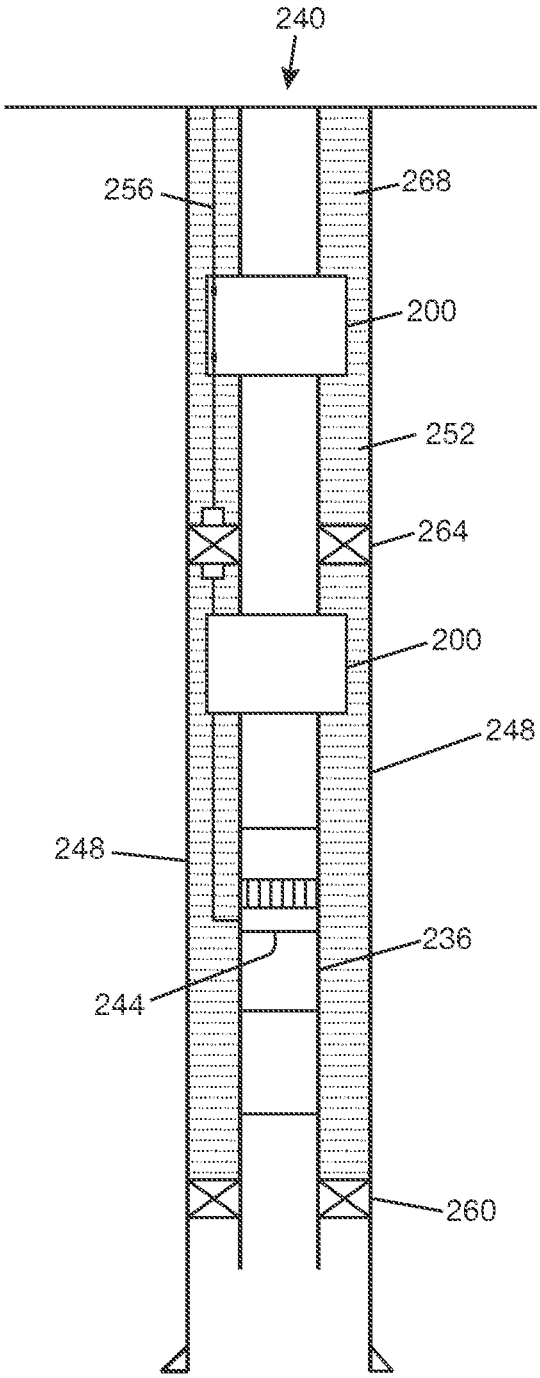
FIG. 4 is a schematic diagram of a well completion showing PSDs installed in an isolated wellbore annulus.

FIG. 4 shows a portion of a completed well 240. A tubing (or downhole tool) 236 is disposed in well 240. Tubing 236 may be a production tubing, for example, or part of a production string. In one example, tubing 236 may include an ESP 244. Tubing 236 may also include one or more PSDs 200, spaced along the length of the tubing. Well 240 includes a casing 248, which is generally concentric with tubing 236. A tubing-casing annulus 252 is defined between casing 248 and tubing 236. ESP 244 is powered through an ESP cable 256. PSDs 200 may include slots for passage of ESP cable 256. Alternatively, ESP cable 256 may run alongside PSDs 200. Both options are shown in FIG. 4 for illustrative purposes. Tubing-casing annulus 252 is sealed at the surface by the wellhead (not shown) and downhole by a packer 260. An additional packer 264 may be set in tubing-casing annulus 252 at a location above ESP 244. To provide mitigation of annular pressure buildup for the portion of tubing-casing annulus between packers 260, 264, at least one of the PSDs 200 may be disposed in this portion of the well. Additional PSDs 200 may be arranged along the length of the tubing to mitigate annular pressure buildup in the portion of tubing-casing annulus 252 above packer 264. In one example, tubing-casing annulus 252 is filled with inhibited brine 268, which constitutes fluid in the external environment of the PSDs 200. During production of fluids, e.g., hydrocarbons, from well 240, well 240 will warm up. As well 240 warms up, inhibited brine 268 will expand, which will cause pressure to rise in tubing-casing annulus 252. PSDs 200 are used to mitigate this pressure buildup.

A method of mitigating pressure buildup in an isolated wellbore annulus may include disposing one or more PSDs in the isolated wellbore annulus. To mitigate pressure buildup in tubing-casing annulus 252, for example, PSDs 200 are disposed in tubing-casing annulus 252. In the example described above and shown in FIG. 4, PSDs are disposed in tubing-casing annulus 252 by including PSDs 200 in tubing 236 and arranging tubing 236 within casing 248. As previously described, each PSD 200 includes a flexible container (232 in FIGS. 2A and 2B) that is pre-filled with a charge of low pressure gas and disposed within an annular chamber (220 in FIGS. 2A and 2B). When tubing 236 with PSDs 200 is disposed in the well as shown in FIG. 4, the annular chambers of the PSDs 200 are in communication with inhibited brine 268 in tubing-casing annulus 252. While producing fluids from the well, the expanding brine from tubing-casing annulus 252 will enter the annular chambers of the PSDs 200. The fluid pressure will longitudinally compress the flexible containers inside the annular chambers of the PSDs. As the flexible containers are compressed, the pressure of the gas contained in the flexible containers will increase, hence the pressure storage. Also, the compressed flexible containers will create additional volume in the annular chambers to receive the expanding brine. This process will continue until the pressure between the tubing-casing annulus 252 and the pressures in the annular chambers of the PSDs 200 are equalized. The number of PSDs 200 to include in tubing 236 may be based on the expected pressure buildup in tubing-casing annulus 252, which may differ from well to well.

Figure 5A:
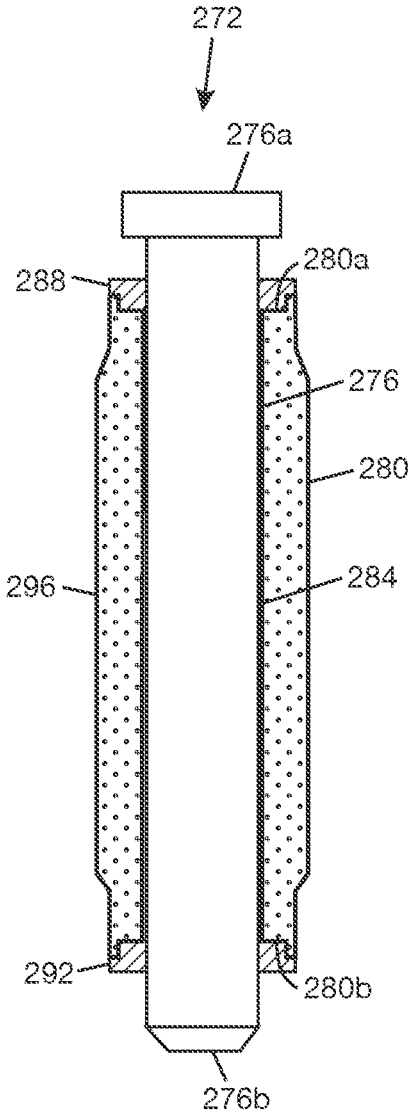
FIG. 5A is a cross-section of a PSD according to another embodiment.

FIG. 5A shows a PSD 272 that can be used to mitigate pressure buildup in an isolated wellbore annulus according to another illustrative implementation. PSD 272 includes a tubular body 276 with end connections 276*a*, 276*b*, e.g., threaded connections or other connections known in the art for connecting tubulars. Tubular body 276 has a longitudinal bore (not shown) for passage of fluids. A flexible container (or deformable container) 280 is disposed around tubular body 276. Flexible container 280 may be, for example, an elastomeric bag, metal bellows, bladder, or the like. Flexible container 280 is pre-filled with a charge of gas and sealed to an external source of gas once pre-filled. This means that flexible container 280 is not connected to an external source of gas, such as a pressure compensator or the like, when disposed in an environment of use. In the example shown in FIG. 5A, flexible container 280 has an annular shape that circumscribes an outer wall surface 284 of tubular body 276. Flexible container 280 may be retained on tubular body 276 in any suitable manner. As a non-limiting example, annular flanges 288, 292 may be provided on outer wall surface 284 of tubular body 276. Annular flanges 288, 292 are spaced apart along the length of tubular body 276. Ends 280*a*, 280*b* of flexible container 280 may be attached to annular flanges 288, 292, respectively. PSD 272 generally differs from PSD 200 in that flexible container 280 is not disposed in an annular chamber and is radially compressed by external pressure. Since PSD 272 is not disposed in an annular chamber, an external surface 296 of flexible container 280 is exposed at an exterior of PSD 272.

Figure 5B:
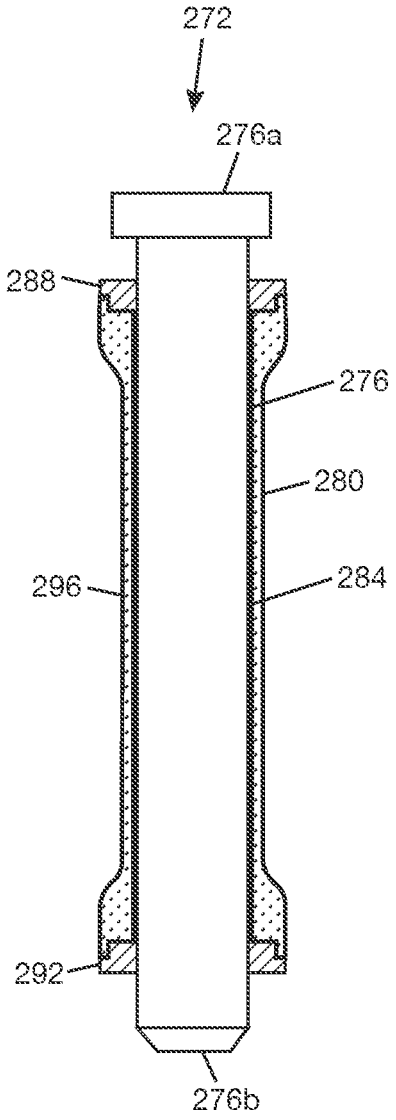
FIG. 5B shows the PSD of FIG. 5A with the flexible container in a compressed state.

When PSD 272 is disposed in an isolated wellbore annulus (as shown for PSD 200 in FIG. 4), external surface 296 of flexible container 280 is exposed directly to the fluid, e.g., inhibited brine, in the isolated wellbore annulus. As the well starts to warm up, the fluid in the wellbore annulus will expand, and the annulus pressure will start to rise, compressing flexible container 280 and the gas contained within flexible container 280. This will cause the pressure of the gas within flexible container 280 to rise, hence the pressure storage. FIG. 5B shows PSD 272 with the flexible container 280 in a compressed or collapsed state. The gas within flexible container 280 has a much higher compressibility than the fluid (liquid) within the wellbore annulus and will take up the excess pressure from the expanding fluid.

Figure 6A:
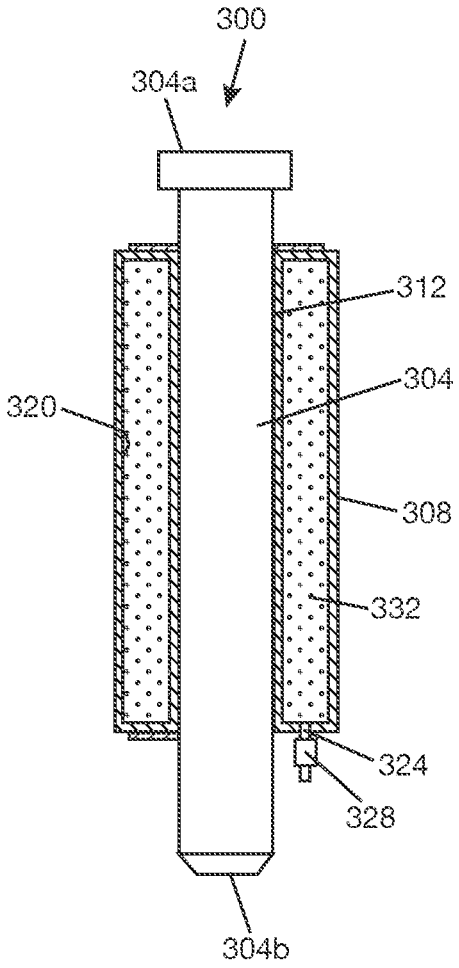
FIG. 6A is a cross-section of a PSD according to another embodiment.

FIG. 6A shows a PSD 300 that can be used to mitigate pressure in an isolated wellbore annulus according to another illustrative implementation. PSD 300 includes a tubular body 304 with end connections 304*a*, 304*b*, e.g., threaded connections or other connections known in the art for connecting tubulars. A rigid container 308 is disposed about an outer wall surface 312 of tubular body 304. In general, a "rigid container" is a container that can withstand pressure applied by fluid in the external environment of the PSD without being deformed—this could be contrasted with the flexible/deformable containers 232, 280 previously mentioned. In one example, rigid container 308 has an annular shape. Rigid container 308 may be retained on tubular body 304 using any suitable means, such as by welding, by a flange, or the like. Rigid container 308 has an internal chamber 320 that can be charged (or filled) with gas. In one example, internal chamber 320 is annular in shape. A fluid port 324 formed in a wall of rigid container 308 defines a flow path between internal chamber 320 and an external environment of PSD 300. A valve 328 is disposed in the flow path between internal chamber 320 and the external environment of PSD 300. For example, valve 328 may be disposed in fluid port 324 or in a flow line connecting to fluid port 324. In one example, valve 328 is normally closed. Valve 328 may be designed to be in the open position when the pressure of fluid in the external environment of PSD 300 exceeds the pressure in internal chamber 320. Valve 328 may be a check valve, a rupture disc, or other flow control device.

Figure 6B:
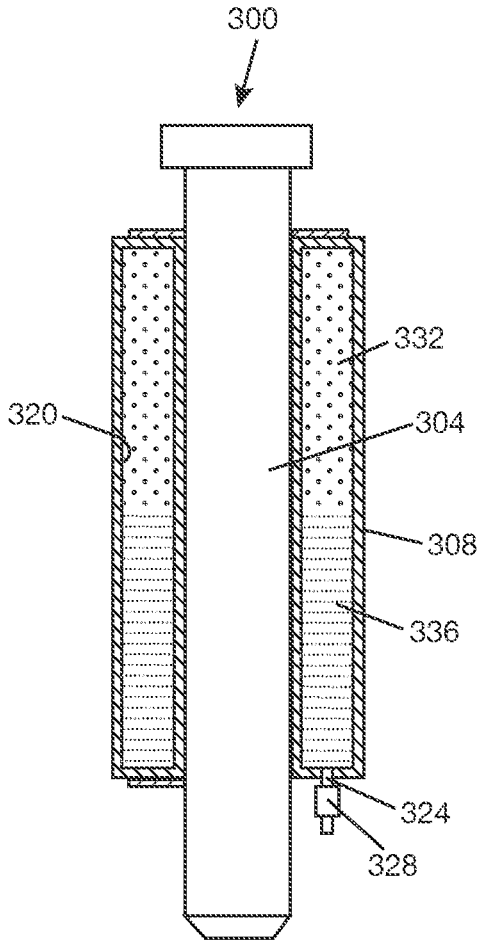
FIG. 6B shows fluid invading an internal chamber of the PSD of FIG. 6A.

To configure PSD 300 for use, internal chamber 320 is pre-filled with a charge of gas 332—a separate gas fill port and valve (not shown) from port 324 and valve 328 may be used. The gas may be nitrogen or other inert gas. In one example, internal chamber 320 is pre-filled with a charge of gas at a low pressure. In a non-limiting example, the pre-fill pressure may be in a range from 0 to 150 psi. In use, valve 328 moves to the open position when the pressure in the external environment of PSD 300 exceeds the pressure within internal chamber 320, allowing fluid from the external environment of PSD 300 to invade internal chamber 320. FIG. 6B shows fluid 336 from the external environment of PSD 300 rising within internal chamber 320 for illustrative purposes. Gas 332 forms a cushion above rising fluid 336 and is compressed. If PSD 300 is disposed in an isolated wellbore annulus, fluid 336 would be the fluid in the isolated wellbore annulus, e.g., inhibited brine.

Figure 7A:
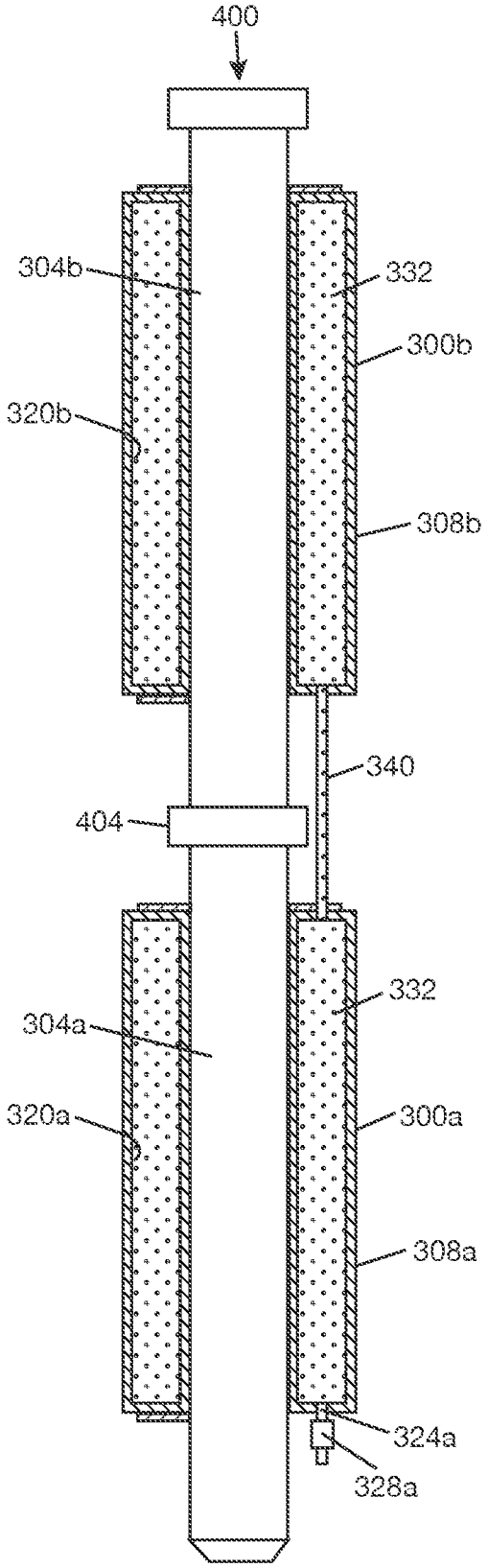
FIG. 7A is a cross-section of a multi-chamber PSD according to another embodiment.

FIG. 7A shows a multi-chamber PSD 400 including two single-chamber PSDs 300*a*, 300*b*. In general, multi-chamber PSD 400 may have two or more single-chamber PSDs. In one example, PSDs 300*a*, 300*b* have a structure that is similar to PSD 300 in FIG. 6A, and similar numbering will be used between FIGS. 6A and 7A for continuity. A connection 404 is formed between tubular body 304*a* of PSD 300*a* and tubular body 304*b* of PSD 300*b*, e.g., using the respective end connections of the tubular bodies. Connection 404 places PSD 300*a* in series, and in axial alignment, with PSD 300*b*. Rigid container 308*a* of PSD 300*a* is disposed about tubular body 304*a*. Rigid container 308*a* has an internal chamber 320*a* that can be charged (or filled) with gas. A fluid port 324*a* and valve 328*a* are provided to allow internal chamber 320*a* to receive fluid from an external environment of PSD 400. Rigid container 308*b* of PSD 300*b* is disposed about tubular body 304*b*. Rigid container 308*a* has an internal chamber 320*b* that can be charged with gas. A conduit 340 is formed between internal chamber 320*b* of PSD 300*b* and internal chamber 320*a* of PSD 300*a* to enable fluid communication between chambers 320*a*, 320*b*.

Figure 7B:
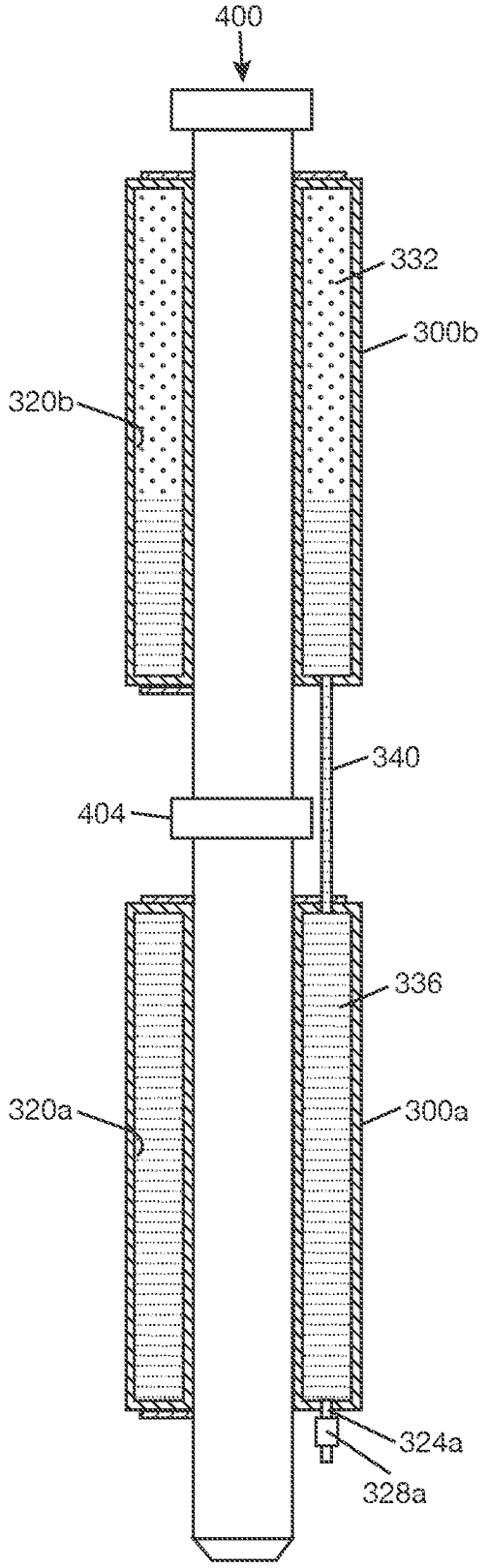
FIG. 7B shows fluid invading internal chambers of the PSD of FIG. 7A.

To configure multi-chamber PSD 400 for use, internal chambers 320*a*, 320*b* are pre-filled with a charge of gas 332. The gas may be nitrogen or other inert gas. In one example, internal chambers 320*a*, 320*b* are pre-filled with a charge of gas at a low pressure. In a non-limiting example, the pre-fill pressure may be in a range from 0 to 150 psi. In use, valve 328*a* opens up when the pressure of fluid outside PSD 400 exceeds the pressure within internal chamber 320*a*, allowing fluid from outside of PSD 400 to enter internal chamber 320*a* through fluid port 324*a*. FIG. 7B shows outside fluid 336 entering internal chamber 320*a*. When internal chamber 320*a* is completely filled with the fluid, the fluid will flow into internal chamber 320*b* through conduit 340. Gas 332 is compressed as fluid rises inside internal chambers 320*a*, 320*b*.

Figure 8A:
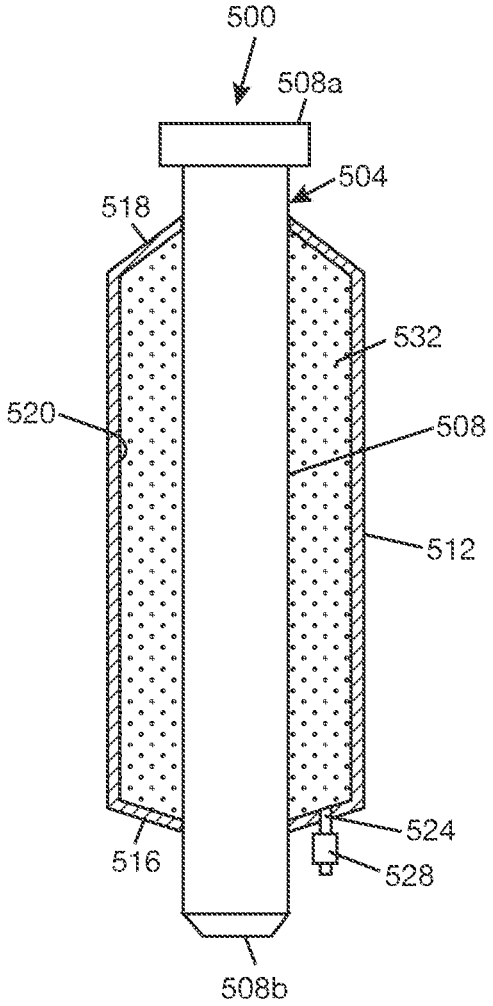
FIG. 8A is a cross-section of a PSD according to another embodiment.

FIG. 8A shows a PSD 500 that can be used to mitigate pressure in an isolated wellbore annulus according to another illustrative implementation. PSD 500 includes a double-walled pipe 504 having an inner pipe (or tube) 508 that is nested within an outer pipe (or tube) 512. An internal chamber 520 is defined between inner pipe 508 and outer pipe 512. Internal chamber 520 may be annular in shape. A fluid port 524 may be formed in bottom wall 516 of outer pipe 512 (or top wall 518 of outer pipe 512) to define a flow path between internal chamber 520 and an external environment of PSD 500. A valve 528 is disposed in the flow path between internal chamber 520 and the external environment of PSD 500, e.g., valve 528 may be disposed in fluid port 524 or in a flow line connecting to fluid port 524. In one example, valve 528 is normally closed. Valve 528 may be designed to be in the open position when the pressure of fluid in the external environment of PSD 500 exceeds the pressure in internal chamber 520. Valve 528 may be a check valve, a rupture disc, or other flow control device. Inner pipe 508 has end connections 508*a*, 508*b*, e.g., threaded connections or other connections known in the art for connecting pipes. A series of PSDs 500 may be connected via end connections of their respective inner pipes.

Figure 8B:
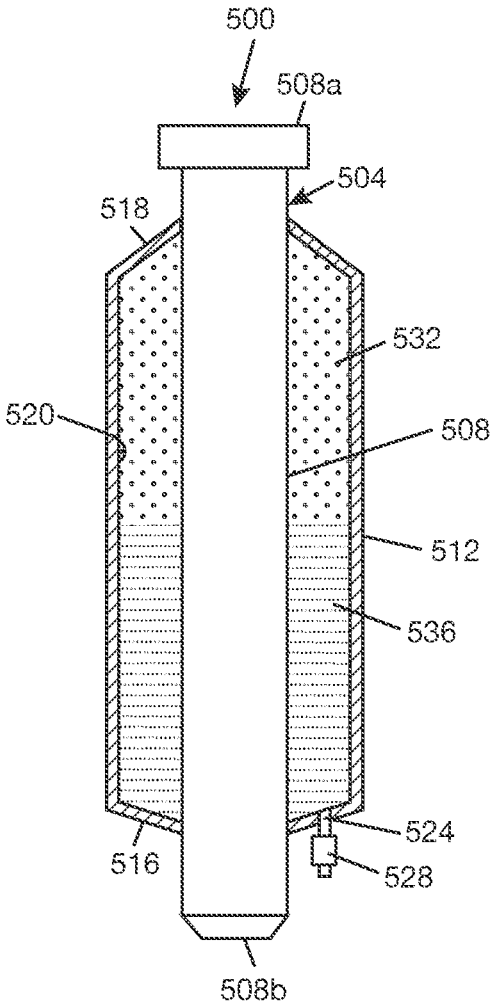
FIG. 8B shows fluid invading an internal chamber of the PSD of FIG. 8A.

To configure PSD 500 for use, internal chamber 520 is pre-filled with a charge of gas 532. The gas may be nitrogen or other inert gas. In one example, internal chamber 520 is pre-filled with a charge of gas at a low pressure. In a non-limiting example, the pre-fill pressure may be in a range from 0 to 150 psi. In use, valve 528 moves to the open position when the pressure in the external environment of PSD 500 exceeds the pressure within internal chamber 520, allowing fluid from the external environment of PSD 500 to invade internal chamber 520, as shown at 536 in FIG. 8B.

Figure 9A:
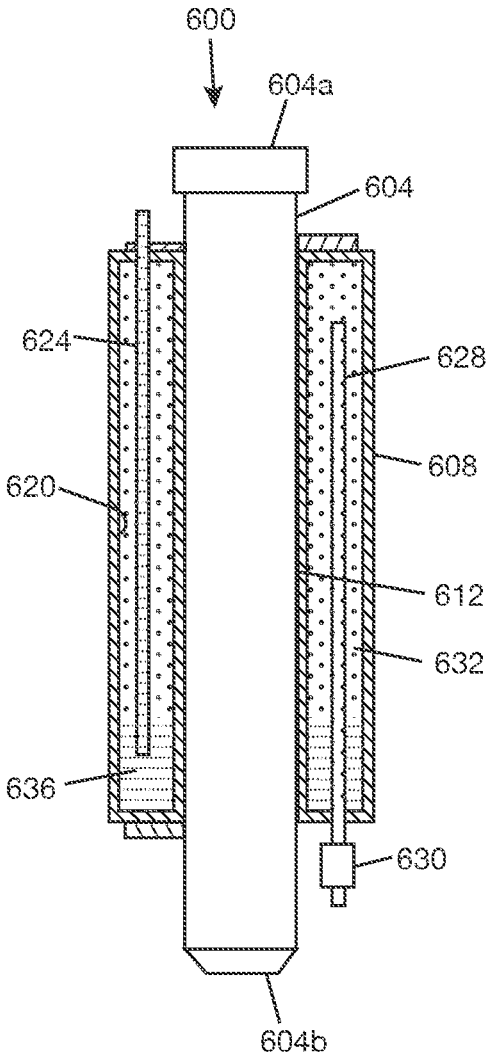
FIG. 9A is a cross-section of a PSD according to another embodiment.

FIG. 9A shows a PSD 600 that can be used to mitigate pressure in an isolated wellbore annulus according to another illustrative implementation. PSD 600 includes a tubular body 604 with end connections 604*a*, 604*b*, e.g., threaded connections or other connections known in the art for connecting tubulars. A rigid container 608 is disposed about an outer wall surface 612 of tubular body 604. In one example, rigid container 608 has an annular shape. Rigid container 608 may be retained on tubular body 604 using any suitable means, such as by welding, by a flange, or the like. Rigid container 608 has an internal chamber 620. In one example, internal chamber 620 is annular in shape. A descender tube 624 extends into internal chamber 620 from above rigid container 608. Descender tube 624 may extend into internal chamber 620 by passing through an opening formed in a top wall of rigid container 608. Descender tube 624 defines a flow path for flow of fluid from an external environment of PSD 600 to internal chamber 620. An ascender tube 628 extends into internal chamber 620 from below rigid container 608. Ascender tube 628 may extend into internal chamber 620 by passing through an opening formed in a bottom wall of rigid container 608. Ascender tube 628 defines a flow path for supply of gas to internal chamber 620. A gas fill valve 630 may be disposed in ascender tube 628. In general, gas fill valve 630 is opened to charge internal chamber 620 with gas and closed when internal chamber 620 has been charged with gas. As in previous examples, internal chamber 620 may be pre-filled with an inert gas, such as nitrogen, at a low pressure. The pre-fill pressure could be, but is not limited to, a pressure in a range from 0 to 150 psi.

To configure PSD 600 for use, gas 632 is supplied to internal chamber 620 through gas fill valve 630 and ascender tube 628. Also, fluid (liquid) 636 is supplied to internal chamber 620 through descender tube 624. The fluid supplied through descender tube 624 may be fluid from the external environment of PSD 600, such as inhibited brine. Fluid 636 and gas 632 are supplied to internal chamber 620 (fluid 636 filling descender tube 624 and a portion of internal chamber 620 will retain gas 632 within internal chamber 620). Then, gas fill valve 630 is closed. In use, e.g., when well production starts and pressure in the external environment of PSD 600 begins to rise, fluid from the external environment of PSD 600 will flow into descender tube 624, causing the level of the fluid 636 in internal chamber 620 to rise. Gas 632 in internal chamber 620 will be compressed as the level of fluid 636 in the chamber rises.

Figure 9B:
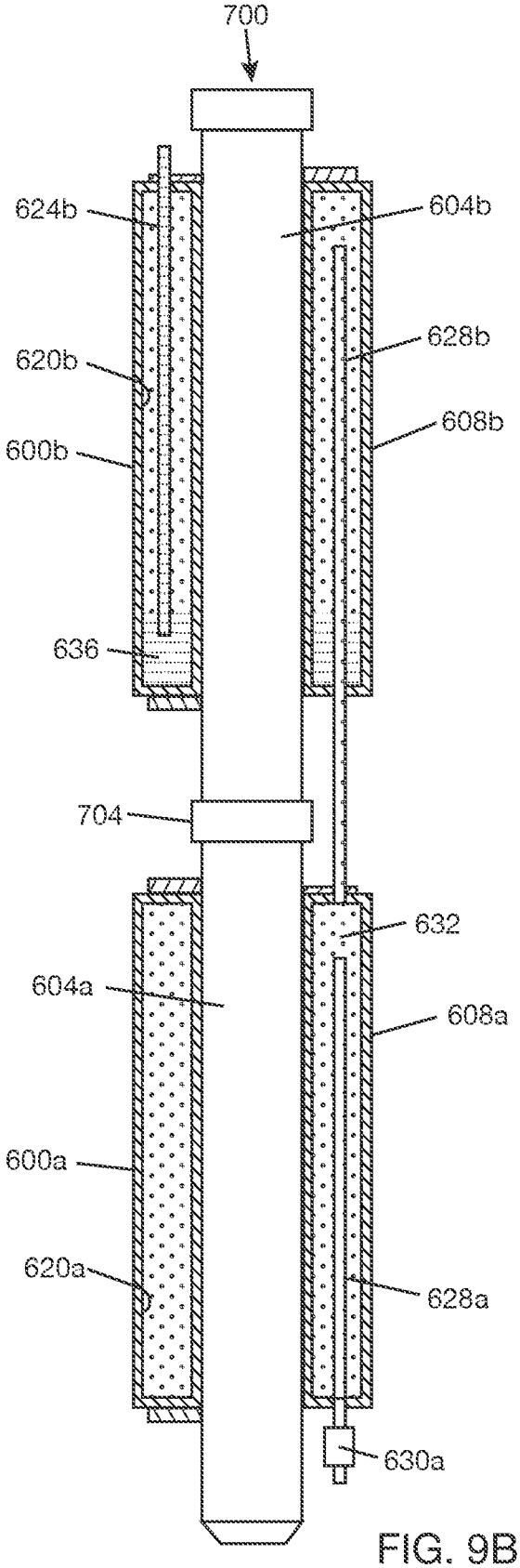
FIG. 9B is a cross-section of a multi-chamber PSD according to another embodiment.

FIG. 9B shows a multi-chamber PSD 700 constructed using two single-chamber PSDs 600*a*, 600*b* having a similar structure to PSD 600 in FIG. 9A. In the interest of continuity, similar numbering will be used between FIGS. 9A and 9B. A connection 704 is formed between tubular body 604*a* of PSD 600*a* and tubular body 604*b* of PSD 600*b*, e.g., using the respective end connections of the tubular bodies. Connection 704 places PSD 600*a* in series, and in axial alignment, with PSD 600*b*. Rigid container 608*a* of PSD 600*a* is disposed about tubular body 604*a*. Rigid container 608*a* has an internal chamber 620*a*. An ascender tube 628*a* extends into internal chamber 620*a*. Rigid container 608*b* of PSD 600*b* is disposed about tubular body 604*b*. Rigid container 608*b* has an internal chamber 620*b* that can be charged with gas. An ascender tube 628*b* extends from internal chamber 620*a* into internal chamber 620*b*. A descender tube 624*b* extends into internal chamber 620*b*.

To configure multi-chamber 600 for use, gas 632 is supplied to internal chamber 620*a* through gas fill valve 630*a* and ascender tube 628*a*. The gas may flow into internal chamber 620*b* through ascender tube 628*b*. Also, fluid (liquid) 636 is supplied to internal chamber 620*b* through descender tube 624*b*. Fluid 636 may be fluid from the external environment of PSD 700, such as brine. Fluid 636 and gas 632 are supplied to internal chambers 620*a*, 620*b* (fluid 636 filling descender tube 624*b* and a portion of internal chamber 620*b* will retain gas 632 within internal chambers 620*a*, 620*b*). Then, gas fill valve 630*a* is closed. In use, e.g., when well production starts and pressure in the external environment of PSD 700 begins to rise, fluid from the external environment of PSD 700 will flow into descender tube 624*b*, causing the level of fluid 636 in internal chamber 620*b* to rise. Gas 632 in internal chamber 620*b* will be compressed as the level of fluid 636 in internal chamber 620*b* rises. Internal chamber 620*a* provides extra capacity for the incoming fluid from the external environment of PSD 700, i.e., fluid 636 may flow into internal chamber 620*a* via ascender tube 628*b*.

Any of the alternate PSDs described in FIGS. 5A-9B could be included in a tubing or downhole tool as shown for PSDs 200 in FIG. 4.

Figure 10:
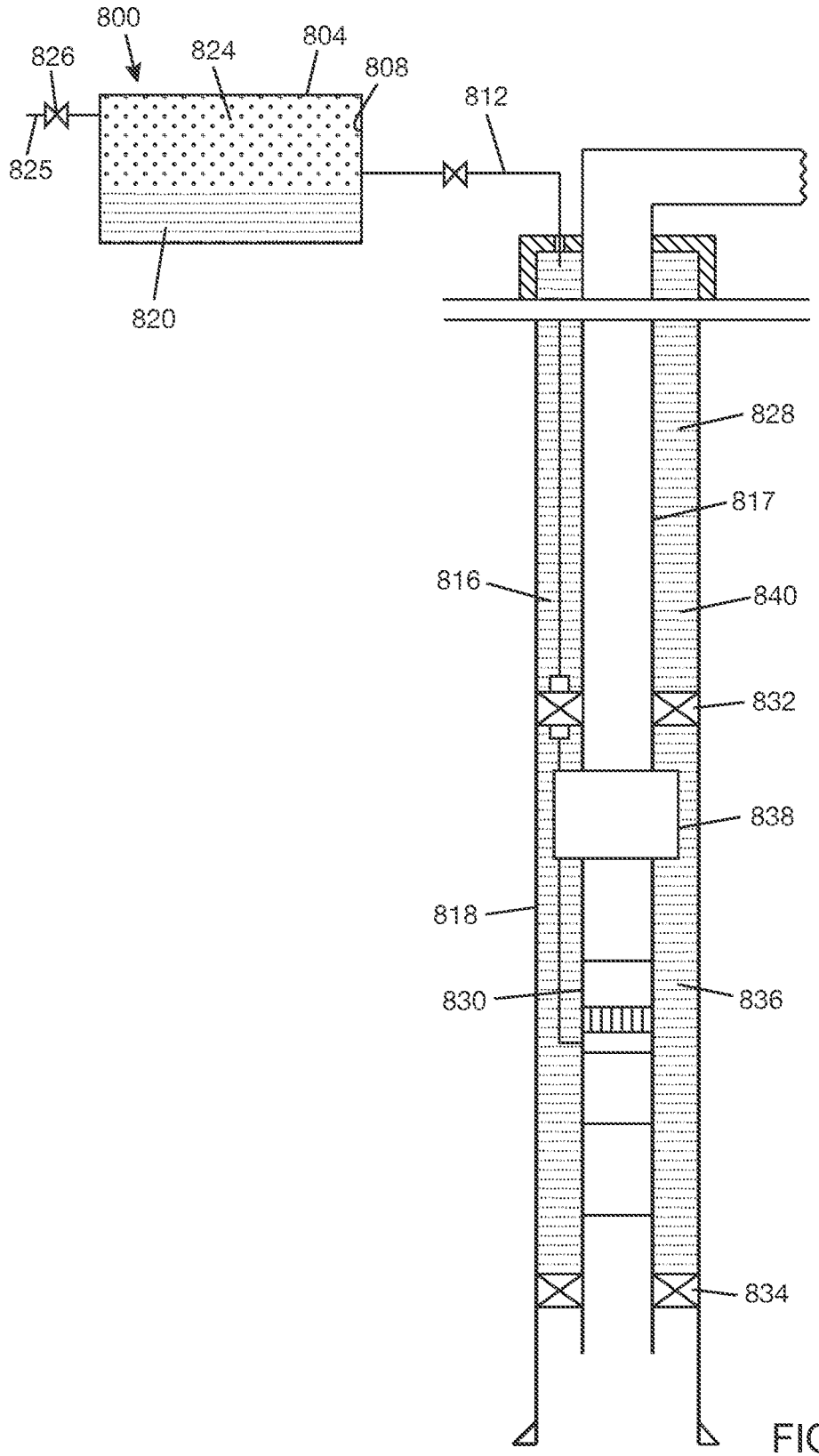
FIG. 10 shows a method of mitigating pressure buildup in a tubing-casing annulus using a surface PSD.

The PSDs described in FIGS. 2A-9B are intended to be disposed in an isolated wellbore annulus having a pressure buildup to be mitigated, i.e., they are intended to be used downhole. In another implementation, a PSD may be provided outside of the isolated wellbore annulus, e.g., at the surface. FIG. 10 shows an example of a surface PSD 800 including a rigid container 804, e.g., a reinforced tank. Rigid container 804 has an internal chamber 808. A conduit 812 is formed between a tubing-casing annulus (isolated wellbore annulus) 816 and internal chamber 808. Tubing-casing annulus 816 is formed between a tubing 817, e.g., a production tubing, and a casing 818 (the setup in FIG. 10 with respect to the tubing 817, casing 818, and tubing-casing annulus 816 is similar to what was previously described with reference to FIG. 4). To configure PSD 800 for use, fluid from tubing-casing annulus 816, e.g., inhibited brine, is allowed to partially fill rigid container 804, as shown at 820. The volume above fluid 820 is filled with gas 824. Gas 824 may be supplied into rigid container 804 through a flow line 825 and fill valve 826. Gas 824 is supplied into rigid container 804 at a low pressure. In non-limiting examples, this low pressure may be at atmospheric pressure or slightly above atmospheric pressure or in a range from 0 to 150 psi. Gas 824 may be nitrogen or other inert gas.

As the well warms up during operation, the excess volume of inhibited brine 828 in tubing-casing annulus 816 due to thermal expansion of the fluid is discharged from tubing-casing annulus 816 into internal chamber 808 through conduit 812. The volume of fluid 820 in rigid container 804 increases as a result, thereby decreasing the volume of gas 824 in the container. The pressure of gas 824 will increase correspondingly. Rigid container 804 needs to be able to withstand the increased pressure. Fluid may continue to flow into internal chamber 808 from tubing-casing annulus 816 until the fluid pressure in internal chamber 808 is equalized with the fluid pressure in tubing-casing annulus 816. In the event of cooling down of the well, the volume of the fluid in tubing-casing annulus 816 decreases or contracts. This will tend to suck in fluid from internal chamber 808 into tubing-casing annulus 816. Also, the pressurized gas 824 will tend to push the fluid from internal chamber 808 into tubing-casing annulus 816. As fluid leaves internal chamber 808, gas 824 will expand to occupy the volume left by the exiting fluid.

Surface PSD 800 may be used in combination with any of the downhole PSDs previously described. For example, tubing 817 may carry an ESP 830, and packers 832, 834 may be disposed above and below ESP 830. In this case, a trapped volume 836 is formed between packers 832, 834 in tubing-casing annulus 816. To mitigate pressure buildup in trapped volume 836, a downhole PSD 838 may be installed in the portion of tubing 817 between packers 832, 834. Downhole PSD 838 may be any of the PSDs previously described with reference to FIGS. 2A to 9B. Moreover, two or more downhole PSDs may be used to mitigate pressure buildup in trapped volume 836. In the volume 840 of the annulus above packer 832, surface PSD 800 may be used to mitigate pressure buildup.

While the invention has been described with respect to a limited number of embodiments, those skilled in the art, having the benefit of this disclosure, will appreciate that other embodiments can be devised that do not depart from the scope of the invention as described herein. Accordingly, the scope of the invention should be limited only by the accompanying claims.

What is claimed is:

1. A device to mitigate pressure buildup in an isolated wellbore annulus containing fluid, the device comprising:

a tubular body having an outer wall surface and a first longitudinal axis;

a chamber, formed with at least one rigid wall, disposed around the outer wall surface of the tubular body and within the isolated wellbore annulus, the chamber having a second longitudinal axis extending in the same direction as the first longitudinal axis, and having an open end near a lower end of the at least one rigid wall; and a flexible container to hold a charge of gas, wherein the flexible container is directly disposed within the chamber and arranged to deform in a direction along the second longitudinal axis in response to fluid pressure changes in the isolated wellbore annulus, wherein the fluid enters the chamber from the isolated wellbore annulus, through the open end, causing the flexible container to deform, wherein deformation of the flexible container allows additional fluid to enter the chamber from the isolated wellbore annulus, and wherein the chamber is configured to hold the fluid and the additional fluid that enters from the open end.

2. The device of claim 1, wherein the flexible container is pre-filled with an inert gas.

3. The device of claim 1, wherein the at least one rigid wall comprises a shroud casing disposed around the outer wall surface of the tubular body, the shroud casing having an inner wall surface radially spaced from the outer wall surface, wherein the chamber is formed between the inner wall surface of the shroud casing and the outer wall surface of the tubular body.

4. The device of claim 3, further comprising at least one support that attaches the shroud casing to the outer wall surface of the tubular body.

5. The device of claim 4, wherein the chamber has a closed end proximate the at least one support and the open end is longitudinally opposed to the closed end, the open end to permit flow of fluid from the isolated wellbore annulus into the chamber.

6. The device of claim 5, wherein the at least one support is a flange carried by the outer wall surface of the tubular body.

7. The device of claim 3, further comprising two supports that attach the shroud casing to the outer wall surface of the tubular body, wherein the two supports are spaced apart in a direction along the first longitudinal axis.

8. The device of claim 7, wherein the chamber extends between the two supports, and wherein at least one of the two supports comprises at least one opening to receive fluid from the isolated wellbore annulus into the chamber.

9. The device of claim 8, further comprising a valve positioned to control flow of fluid through the at least one opening in response to fluid pressure changes in the isolated wellbore annulus.

10. The device of claim 1, wherein the flexible container has longitudinally opposed ends, and wherein the flexible container is restrained at one of the longitudinally opposed ends.

11. The device of claim 1, wherein the flexible container comprises an elastomeric bag, metal bellows, or a bladder.

12. The device of claim 1, further comprising end connections that connect the device to a production tubing.

13. The device of claim 12, further comprising an electrical submersible pump disposed within the production tubing.

14. A device to mitigate pressure buildup in an isolated wellbore annulus containing fluid, the device comprising:

a tubular body, disposed in the isolated wellbore annulus, having a solid outer wall surface; and a flexible container pre-filled with a charge of gas and sealed to an external source of gas once pre-filled and when disposed in an environment of use, the flexible container disposed around the outer wall surface of the tubular body, the flexible container having an external surface that is exposed at an exterior of the device, the flexible container being configured to deform in response to fluid pressure from the isolated wellbore annulus acting on the external surface.

15. The device of claim 14, wherein the flexible container is pre-filled with an inert gas and is retained on the outer wall surface of the tubular body.

16. The device of claim 14, further comprising end connections that connect the device to a production tubing.

17. A method of mitigating pressure buildup in an isolated wellbore annulus containing fluid, the method comprising:

pre-filling a flexible container with a charge of gas and sealing the flexible container to an external source of gas once pre-filled with the charge of gas and when disposed in an environment of use;

disposing the flexible container pre-filled with the charge of gas in the isolated wellbore annulus; and causing the flexible container to deform in response to fluid pressure changes from the isolated wellbore annulus, wherein deformation of the flexible container lowers pressure buildup in the isolated wellbore annulus.

18. The method of claim 17, further comprising:

retaining the flexible container pre-filled with the charge of gas within a chamber formed with at least one rigid wall such that the flexible container is longitudinally deformable within the chamber;

wherein disposing the flexible container pre-filled with the charge of gas in the isolated wellbore annulus comprises disposing the chamber with the flexible container retained therein in the isolated wellbore annulus; and in response to the fluid pressure changes in the isolated wellbore annulus, receiving expanding fluid into the chamber from the isolated wellbore annulus, the expanding fluid exerting a pressure on the flexible container that longitudinally deforms the flexible container and compresses the gas within the flexible container.

19. The method of claim 18, wherein pre-filling the flexible container with a charge of gas comprises pre-filling the flexible container with an inert gas.

20. The method of claim 18, wherein disposing the chamber with the flexible container retained therein in the isolated wellbore annulus comprises coupling the chamber with the flexible container retained therein to a downhole tool and deploying the downhole tool into a well comprising the isolated wellbore annulus.

* * * * *